US008824904B2

(12) United States Patent
Sasaki et al.

(10) Patent No.: US 8,824,904 B2
(45) Date of Patent: Sep. 2, 2014

(54) FIXING DEVICE AND IMAGE FORMING APPARATUS

(75) Inventors: Kosuke Sasaki, Toyokawa (JP); Naoki Ohashi, Toyokawa (JP); Isao Watanabe, Toyohashi (JP); Yasuhiro Ishihara, Toyohashi (JP); Hiroyuki Yoshikawa, Toyohashi (JP)

(73) Assignee: Konica Minolta Business Technologies, Inc., Chiyoda-Ku, Tokyo (JP)

( * ) Notice: Subject to any disclaimer, the term of this patent is extended or adjusted under 35 U.S.C. 154(b) by 191 days.

(21) Appl. No.: 13/479,510

(22) Filed: May 24, 2012

(65) Prior Publication Data

US 2012/0301162 A1 Nov. 29, 2012

(30) Foreign Application Priority Data

May 26, 2011 (JP) ..... 2011-118049

(51) Int. Cl.
*G03G 15/20* (2006.01)

(52) U.S. Cl.
CPC ..... *G03G 15/2042* (2013.01)
USPC ..... 399/33; 399/44

(58) Field of Classification Search
CPC ..... G03G 15/2014; G03G 15/2042; G03G 15/2082
USPC ..... 399/33, 44, 69, 94, 329
See application file for complete search history.

(56) References Cited

U.S. PATENT DOCUMENTS

| | | | | |
|---|---|---|---|---|
| 2007/0230984 | A1* | 10/2007 | Noguchi | 399/69 |
| 2008/0240748 | A1* | 10/2008 | Kinouchi et al. | 399/33 |
| 2009/0169231 | A1* | 7/2009 | Asakura et al. | 399/69 |
| 2012/0219308 | A1 | 8/2012 | Fukaya | |

FOREIGN PATENT DOCUMENTS

| | | | |
|---|---|---|---|
| JP | 08-069328 | A | 3/1996 |
| JP | 10-020708 | A | 1/1998 |
| JP | 2000-227732 | A | 8/2000 |
| JP | 2001-175102 | A | 6/2001 |
| JP | 2003-066761 | A | 3/2003 |
| JP | 2009-204745 | A | 9/2009 |
| JP | 2011-253140 | A | 12/2011 |
| JP | 2012-177790 | A | 9/2012 |

OTHER PUBLICATIONS

Office Action (Decision to Grant a Patent) issued on Jul. 30, 2013, by the Japanese Patent Office in corresponding Japanese Patent Application No. 2011-118049, and an English Translation of the Office Action. (3 pages).

* cited by examiner

*Primary Examiner* — David Gray
*Assistant Examiner* — Thomas Giampaolo, II
(74) *Attorney, Agent, or Firm* — Buchanan Ingersoll & Rooney

(57) ABSTRACT

A fixing device includes a temperature measuring unit, configured to measure the temperature in regions that extend partially along the outer surface of a heating rotating body, which includes a resistance heating layer, in the circumferential direction and are aligned in the direction of the axis of rotation of the heat rotating body, and a control unit configured to sample temperatures, measured by the temperature measuring unit in each of the regions, over the entire outer surface of the heating rotating body in the circumferential direction by causing the heating rotating body to rotate while supplying a predetermined amount of power to the resistance heating layer, and to determine whether an abnormality has occurred in the resistance heating layer based on the difference between the maximum temperature and the minimum temperature among the sampled temperatures in each region.

8 Claims, 9 Drawing Sheets

FIXING DEVICE AND IMAGE FORMING APPARATUS

CROSS-REFERENCE TO RELATED APPLICATIONS

This application is based on application No. 2011-118049 filed in Japan, the content of which is hereby incorporated by reference.

TECHNICAL FIELD

The present invention relates to a fixing device for thermally fixing an unfixed image on a recording sheet and to an image forming apparatus provided with such a fixing device.

BACKGROUND ART

In an image forming apparatus based on electrophotography, such as a printer or a copier, a toner image corresponding to image data is transferred to a recording sheet, such as plain paper or an OHP sheet, and is then fixed by a fixing device. The fixing device heats and applies pressure to the toner image on the recording sheet in order to fix the toner image to the recording sheet.

Patent Literature 1 (Japanese Patent Application Publication No. 2000-227732) discloses a fixing device that controls the surface temperature of a heat roller heated by a heating means, such as a halogen heater, to be a predetermined temperature by detecting the surface temperature using an infrared sensor. In this fixing device, the infrared sensor is moveable parallel to the axis of the heat roller, so that one infrared sensor can detect the surface temperature at a plurality of positions along the axis of the heat roller. Based on variation in the measured surface temperature, the heating means, such as a halogen heater, is controlled.

In recent years, a system has also been adopted wherein a resistance heating element that generates heat by conduction is used as the heating means in a fixing device. In this system, the resistance heating element is, for example, provided in a rotating heating belt. The outer circumferential surface of the heating belt and a pressing roller press against each other to form a fixing nip, and recording sheets pass through the fixing nip.

The resistance heating element provided in the heating belt is supplied with power at either edge in the direction of width (along the rotation axis), which is perpendicular to the direction of rotation of the heating belt. The resistance heating layer produces Joule heat due to the current flowing along the direction of width. The heat thus produced in the resistance heating layer traverses the fixing nip and is applied to the recording sheet. The toner image on the recording sheet is thus thermally fixed.

In this sort of fixing device, since the heating belt, which is the source of heat, has a low heat capacity, the warm-up time can be kept short. Moreover, since the distance from the resistance heating layer in the heating belt to the recording sheet is short, heat produced in the resistance heating layer is efficiently applied to the recording sheet. Accordingly, the amount of consumed energy can be reduced both during warm-up and during fixing operations.

In a fixing device that uses a heating belt with a resistance heating layer, however, the problem occurs that the resistance heating layer may be damaged by improper jam clearance when a jam occurs or by a foreign object attached to the recording sheet. If the damage to the resistance heating layer, such as a scratch, occurs along the circumferential direction of the heating belt (a direction perpendicular to the direction in which current flows in the resistance heating layer, i.e. perpendicular to the direction of width of the heating belt), a locally high temperature may be reached along the circumference of the scratched location.

The reason for occurrence of a high temperature is as follows. If a scratch occurs along the circumferential direction of the resistance heating layer, then along the circumference of the scratch, current cannot flow in the direction of width of the heating belt. Rather, the current has to flow around the scratch. As a result, current becomes locally concentrated in the circumferential direction of the resistance heating layer at either circumferential end of the scratch. The current density thus increases at the circumferential ends of the scratch. As a result, the circumferential ends of the scratch overheat, reaching a locally high temperature.

Such a locally high temperature in the heating belt may cause image noise, such as high temperature offset. Furthermore, if a long scratch occurs in the circumferential direction of the heating belt, the current density rises even more at either circumferential end of the scratch, which may lead to an abnormally high temperature. In this case, the fixing device may suffer damage, such as melting of the surface of the pressing roller that presses against the heating belt.

Therefore, it is preferable to detect that damage, such as a scratch, has occurred on the resistance heating layer of the heating belt in order to prevent problems such as image noise and damage to the pressing roller.

As described above, in the case of a scratch in the circumferential direction of the resistance heating layer, the temperature at the circumferential ends of the scratch becomes high. Therefore, if portions with a locally high temperature are detected, it can be determined that a scratch has occurred in the resistance heating layer.

For example, the infrared sensor disclosed in Patent Literature 1 detects an average temperature within a measurement region, defined as a constant range on the surface of the opposing heating belt (a range over a fixed area at one location in the direction of width of the heating belt). While such an infrared sensor displaces the measurement region along the entire circumferential surface of the rotating heating belt, if the average value of the measured temperature obtained at a predetermined sampling time is higher than a preset threshold temperature, it can be determined that a scratch has occurred in the resistance heating layer within the measurement region.

In this case, however, since the infrared sensor detects an average temperature for a measurement region with a constant area, the average temperature along the entire circumferential surface of the heating belt might not be equal to or greater than the predetermined threshold temperature even if the temperature at the circumferential ends of a scratch on the resistance heating layer is at least the threshold temperature. This is because the measurement area of the infrared sensor at the sampling time may be larger than the locally high temperature portions, causing the measured temperature (average temperature) in the measurement area at the sampling time to be lower than the actual temperature of the locally high temperature portions. In such a case, even though the resistance heating layer has been scratched, the scratch cannot be detected.

Furthermore, even when it can be detected that a scratch to the resistance heating layer has occurred, the length in the circumferential direction of the scratch is unclear. As a result, use of the image forming apparatus may be restricted due to suspension of fixing operations, even when the scratch in the resistance heating layer is not long in the circumferential direction to pose the risk of damage to the pressing roller.

SUMMARY OF INVENTION

The present invention has been conceived in light of the above problems, and it is an object thereof to provide a fixing device that accurately and unerringly determines when an abnormality, such as a scratch or the like, has occurred in the resistance heating layer. It is another object of the present invention to provide an image forming apparatus that includes such a fixing device.

In order to achieve the above object, a fixing device according to an aspect of the present invention comprises a heating rotating body including a resistance heating layer; a pressing member forming a nip by pressing against an outer circumferential surface of the heating rotating body and causing a recording sheet to pass through the nip, the recording sheet bearing an unfixed image; a temperature measuring unit configured to measure a temperature in each of a plurality of regions extending partially along the outer surface of the heating rotating body in a circumferential direction and aligned in a direction of an axis of rotation of the heat rotating body; and a control unit configured to sample temperatures, measured by the temperature measuring unit in each of the plurality of regions, over the entire outer surface of the heating rotating body in the circumferential direction by causing the heating rotating body to rotate while supplying a predetermined amount of power to the resistance heating layer, and to determine whether an abnormality has occurred in the resistance heating layer in accordance with a difference between a maximum temperature and a minimum temperature among the sampled temperatures in each of the plurality of regions.

An image forming apparatus according to an aspect of the present invention is provided with the fixing device.

BRIEF DESCRIPTION OF DRAWINGS

These and the other objects, advantages and features of the invention will become apparent from the following description thereof taken in conjunction with the accompanying drawings which illustrate specific embodiments of the present invention.

DESCRIPTION OF EMBODIMENTS

Embodiment 1

The following describes an embodiment of an image forming apparatus provided with a fixing device according to an aspect of the present invention.

Structure of Image Forming Apparatus

Figure 1:
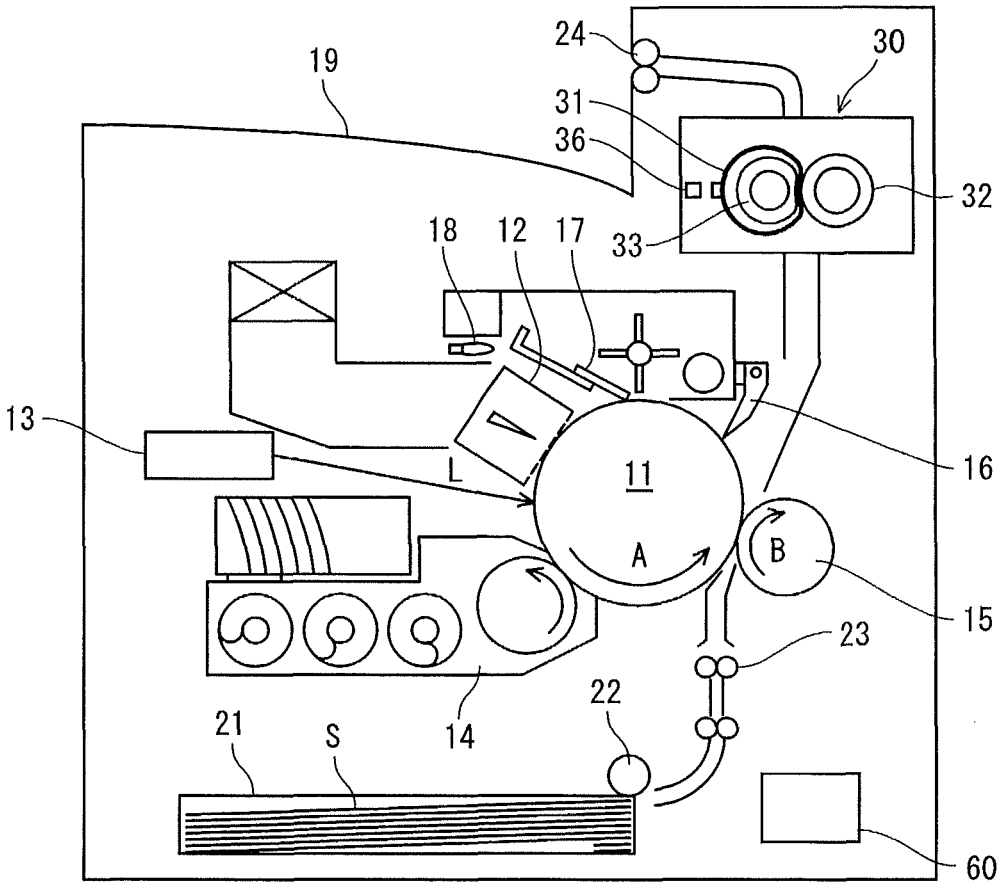
FIG. 1 is a schematic diagram showing the structure of a printer as an example of an image forming apparatus according to Embodiment 1 of the present invention.

FIG. 1 is a schematic diagram showing the structure of a printer as an example of an image forming apparatus according to Embodiment 1 of the present invention. Based on image data or the like that is input over a network (such as a LAN) from an external device such as a terminal, the printer forms a monochrome image on a recording sheet, such as plain paper, an OHP sheet, or the like, using well-known electrophotography.

The printer in FIG. 1 includes a photoconductive drum 11 driven to rotate in the direction shown by the arrow A. Surrounding the photoconductive drum 11, in order from the upstream direction of rotation towards the downstream direction, a charging device 12, an exposure device 13, a developing device 14, and a transfer roller 15 are provided to form a toner image on a recording sheet S by electrophotography.

The charging device 12 is provided facing a position that is downstream, in the direction of rotation, from the uppermost portion of the photoconductive drum 11. The charging device 12 uniformly charges the surface of the rotating photoconductive drum 11.

Having been uniformly charged by the charging device 12, the surface of the photoconductive drum 11 is exposed to laser light L emitted by the exposure device 13.

A laser diode is provided in the exposure device 13. A control unit, not shown in the figures, converts image data input from an external device into a drive signal for the laser diode. The laser diode is driven by the drive signal. Laser light L corresponding to the image data is thus emitted from the exposure device 13 onto the surface of the photoconductive drum 11, thus forming an electrostatic latent image on the surface of the photoconductive drum 11.

The developing device 14 is provided facing the photoconductive drum 11 at a position downstream, in the direction of rotation, from the position on the surface of the photoconductive drum 11 that is exposed to the laser light L from the exposure device 13. Using toner, the developing device 14 develops the electrostatic latent image formed on the surface of the photoconductive drum 11. The electrostatic latent image on the surface of the photoconductive drum 11 is thus converted into a visible toner image.

A recording sheet cassette 21, capable of holding a plurality of recording sheets S, such as plain paper or OHP sheets, is provided below the developing device 14. A feed roller 22 that feeds the recording sheets S in the recording sheet cassette 21 one sheet at a time is provided below the photoconductive drum 11. A recording sheet S fed from the recording sheet cassette 21 by the feed roller 22 is transported towards the photoconductive drum 11 located above the feed roller 22.

A pair of timing rollers 23 are provided between the feed roller 22 and the photoconductive drum 11. In synchronization with rotation of the photoconductive drum 11, the pair of timing rollers 23 transport the recording sheet S fed from the recording sheet cassette 21 so as to touch the surface of the photoconductive drum 11.

A transfer roller 15 is provided at one lateral end of the photoconductive drum 11. The transfer roller 15 presses against the photoconductive drum 11 and is caused, by rotation of the photoconductive drum 11, to rotate in the direction shown by arrow B. A transfer nip is formed between the transfer roller 15 and the photoconductive drum 11. The recording sheet S is transferred by the pair of timing rollers 23 towards the transfer nip in synchronization with rotation of the photoconductive drum 11.

The toner image formed on the photoconductive drum 11 is transferred to the recording sheet S that traverses the transfer nip due to an electrical field generated in the transfer region by a transfer voltage applied to the transfer roller 15. The recording sheet S with the toner image transferred thereon is separated from the photoconductive drum 11 by a separation claw 16 and then conveyed to the fixing device 30.

In the fixing device 30, the unfixed toner image on the recording sheet S is heated and pressed against the recording sheet S. The toner image is thus fixed to the recording sheet S. The recording sheet S with the toner image fixed thereon is ejected by a discharge roller 24 into a discharge tray 19.

A cleaner 17 is provided above the photoconductive drum 11. The cleaner 17 removes residual toner from the surface of the photoconductive drum 11 after transfer of the toner image. After removal of the residual toner by the cleaner 17, the remaining charge on the surface of the photoconductive drum 11 is eliminated by an eraser 18. After elimination of the remaining charge, the surface of the photoconductive drum 11 is charged by the charging device 12 in response to the next image formation instruction. Subsequently, the same operations as above are repeated to form another toner image on a recording sheet.

Structure of Fixing Device

Figure 2:
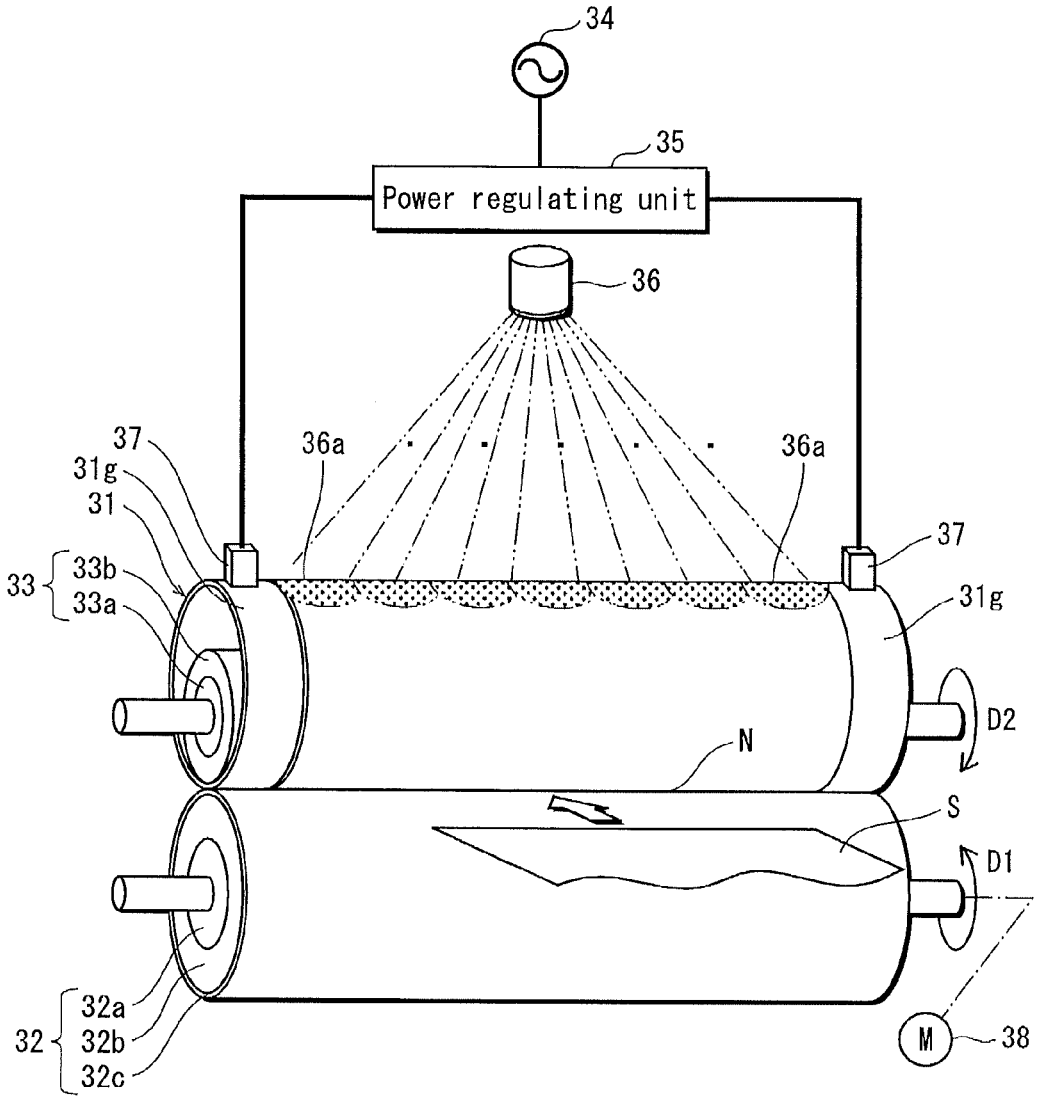
FIG. 2 is a perspective view schematically showing the main structure of a fixing device provided in the printer shown in FIG. 1.
Figure 3:
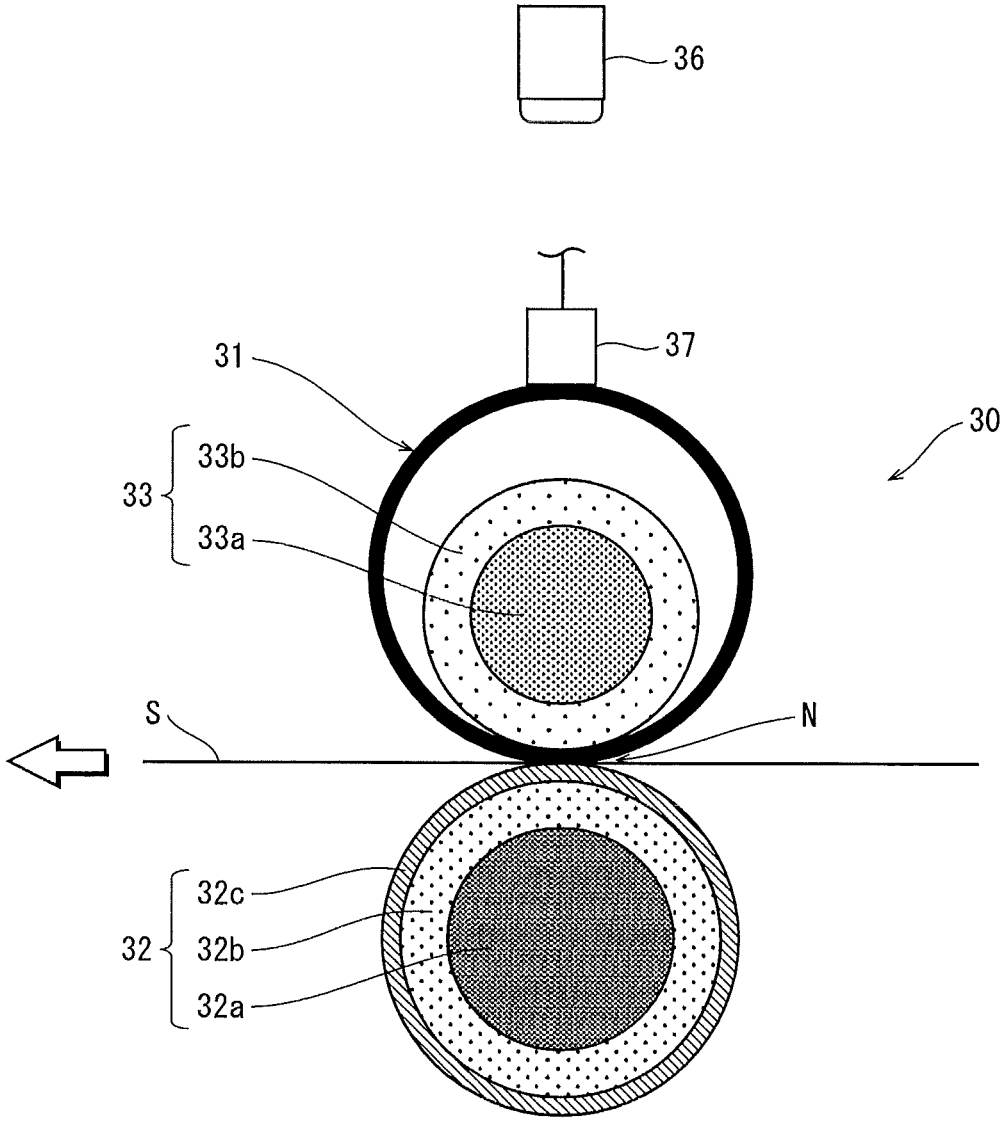
FIG. 3 is a lateral cross-section diagram schematically showing the main structure of the fixing device shown in FIG. 2.

FIG. 2 is a perspective view schematically showing the main structure of the fixing device 30. FIG. 3 schematically shows a lateral cross-section of the fixing device 30. Note that as shown in FIG. 1, recording sheets traverse the fixing device 30 from bottom to top. FIG. 2, on the other hand, shows the fixing device 30 in an orientation such that recording sheets move from the front of the figure towards the back of the figure, and FIG. 3 shows the recording sheets moving from the right of the figure to the left.

As shown in FIGS. 2 and 3, the fixing device 30 is provided with a pressing roller 32, a heating belt 31, and a fixing roller 33. The pressing roller 32 functions as a pressing member. The heating belt 31 is positioned so as to rotate while the outer circumferential surface thereof is pressed upon by the pressing roller 32. The fixing roller 33 is provided inside the rotational area of the heating belt 31 and presses against the inner circumferential surface of the heating belt 31.

A resistance heating layer 31*b* (see FIG. 4) that produces heat by being supplied power is provided on the heating belt (heating rotating body) 31. The heating belt 31 heats up due to heat produced by the resistance heating layer 31*b* and rotates in a heated state.

The length of the heating belt 31 along the axis of rotation (direction of width), perpendicular to the direction of rotation, is for example nearly equivalent to the length of the outer circumferential surface of the pressing roller 32 along the axis thereof. The heating belt 31 is, for example, cylindrical with a slightly larger diameter than the diameter of the pressing roller 32. The rotational axes of the heating belt 31 and the pressing roller 32 are parallel, and the outer circumferential surface of the heating belt 31 and the outer circumferential surface of the pressing roller 32 press against each other. By pressing against each other, the heating belt 31 and the pressing roller 32 form a fixing nip N that the recording sheet S traverses.

Figure 4:
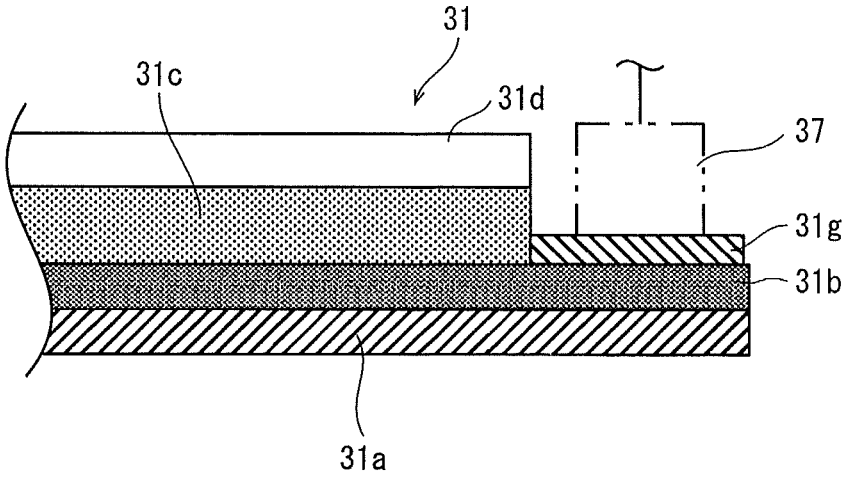
FIG. 4 is a longitudinal cross-section diagram of one end in the direction of width (along the rotational axis), perpendicular to the direction of rotation, of a heating belt provided on the fixing device shown in FIG. 2.

FIG. 4 is a longitudinal cross-section diagram of one edge of the heating belt 31 along the axis thereof, which is perpendicular to the direction of rotation of the heating belt 31. The heating belt 31 includes a cylindrical reinforcing layer 31*a* of a constant thickness made from polyimide (PI), for example. A resistance heating layer 31*b* is layered on the entire outer circumferential surface of the reinforcing layer 31*a*.

Electrodes 31*g* are provided at either edge of the resistance heating layer 31*b* in the axial direction. The electrodes 31*g* cover the entire outer circumferential surface and conduct electricity to the resistance heating layer 31*b*. The electrodes 31*g* are provided at either end of the fixing nip N in the axial direction (i.e. on the outside of the fixing nip N). A pair of power feeders 37 respectively press against the outer circumferential surface of the electrodes 31*g* in a conducting state in order to supply power to the electrodes 31*g*.

An elastic layer 31*c* is layered on the outer circumferential surface of the portion of the resistance heating layer 31*b* between the electrodes 31*g*. A releasing layer 31*d* is layered on the outer circumferential surface of the elastic layer 31*c*.

As shown in FIG. 2, alternating power supplied by a commercial alternating power source 34 is provided to the power feeders 37 via a harness after being regulated to a predetermined power by a power regulating unit 35.

The power feeders 37 are, for example, composed of a conducting brush formed by mixing and baking a powder such as carbon or copper powder. Due to rotation of the heating belt 31, the power feeders 37 are in sliding contact with the respective electrodes 31*g* against which the power feeders 37 press. The conductive state between the power feeders 37 and the electrodes 31*g*, which press against each other, is thus maintained.

Note that the power feeders 37 are not limited to being a conducting brush, so long as the conductive state can be maintained by sliding contact with the electrodes 31*g*. For example, the power feeders 37 may be a conducting body formed from metal or the like, or may be an insulating surface with a plating of Cu, Ni, or the like. Furthermore, the power feeders 37 may be rotating bodies, such as rollers that rotate while in contact with the respective rotating electrodes 31*g*.

A temperature sensor 36 that measures the temperature of the outer circumferential surface of the heating belt 31 is provided facing a position on the outer circumferential surface of the heating belt 31 that is 180° distant from the position on the outer circumferential surface pressed upon by the pressing roller 32. The temperature sensor 36 can individually measure the temperature of the outer circumferential surface of the heating belt 31 in a plurality of regions yielded by dividing the entire width of the heating belt 31.

The temperature sensor 36 has, for example, a multi-thermopile array that integrates a plurality of thermopiles into a linear sequence. The temperature sensor 36 is provided facing a central region of the surface (outer circumferential surface) of the heating belt 31 in the direction of width thereof so that the sequence of thermopiles is arranged along the direction of width.

The temperature sensor 36 is provided at a predetermined distance from the surface of the heating belt 31 so that measurement regions 36*a* for the integrated plurality of thermopiles are approximately equivalent in area and line up without any gaps along the outer circumferential surface of the heating belt 31 across the entire direction of width of the heating belt 31, excluding the electrodes 31*g* at either end in the direction of width. Each thermopile in the temperature sensor 36 measures the average temperature in the entire measurement region 36*a* of predetermined area on the outer circumferential surface of the heating belt 31. The surface temperature of the heating belt 31 as measured by the temperature sensor 36 is used for detecting whether an abnormality, such as a scratch, has occurred on the heating belt 31, and for controlling the surface temperature of the heating belt 31 to be a predetermined value.

In order to detect an abnormality, such as a scratch, occurring in the resistance heating layer 31*b* of the heating belt 31 at any location, the measurement regions 36*a* for the thermopiles in the temperature sensor 36 need to be continuous along nearly the entire direction of width of the heating belt 31 between the electrodes 31*g*. Therefore, the edges of adjacent measurement regions 36*a* may overlap, or the edges of adjacent measurement regions 36*a* may be touching without overlapping.

Note that the number of measurement regions 36*a* for the thermopiles in the temperature sensor 36 is not particularly limited and may be set as needed based on factors such as the length of the heating belt 31 in the direction of width, the area of the measurement regions 36*a*, and the required degree of precision in measurement. Normally, the number of measurement regions 36*a* is approximately between 5 and 20.

The temperature sensor 36 is not limited to being a multi-thermopile array and may adopt a structure in which individual thermopiles are lined up along the direction of width of the heating belt 31. Furthermore, when the number of measurement regions 36*a* is large, the number of thermopiles may be increased, or a plurality of multi-thermopile arrays each including a predetermined number of thermopiles may be lined up along the direction of width of the heating belt 31.

When a plurality of multi-thermopile arrays are used as the temperature sensor 36, the number of multi-thermopile arrays can be reduced, since each thermopile has a wide angular field of view. As a result, the temperature sensor 36 can be reduced in size, thereby saving space.

The temperature sensor 36 is not limited to being a thermopile or a multi-thermopile array. Alternatively, thermography or the like may be adopted. In any case, the temperature sensor 36 has a plurality of measurement regions for detecting the temperature across the entire width of the outer circumferential surface of the heating belt 31, which forms the fixing nip N.

Note that when thermopiles, a multi-thermopile array, or thermography are used as the temperature sensor 36, the temperature on the surface of the heating belt 31 can be measured over predetermined ranges in the direction of width from a fixed position facing the surface of the heating belt 31. Accordingly, it is not necessary to provide a mechanism for displacing the temperature sensor 36, thus eliminating the risk of a loss in reliability of the temperature sensor 36 due to a problem such as malfunction of the displacement mechanism.

Instead of a structure for the temperature sensor 36 to face the surface of the heating belt 31 from a fixed position, a structure to displace one thermopile along the direction of width of the heating belt 31 may be adopted. Alternatively, a structure to cause the measurement range of one thermopile to sway back and forth repeatedly in the direction of width of the heating belt 31 may be adopted.

Furthermore, a structure may be adopted wherein one thermopile is fixed at the periphery of the heating belt 31, and light emitted by the thermopile is reflected along the direction of width of the heating belt 31. In this case, a reflecting device that rapidly displaces a reflecting mirror may be used. Thus using a reflecting device that rapidly displaces a reflecting mirror allows for a simpler structure than when the temperature sensor 36 itself is rapidly displaced, thereby reducing the risk of problems such as malfunction of the reflecting device.

The resistance heating layer 31*b* provided on the reinforcing layer 31*a* of the heating belt 31 is cast as a predetermined cylinder of heat resistant resin in which conductive filler or high-ion conductive powder material is uniformly dispersed. The resistance heating layer 31*b* is adjusted to have uniform electrical resistance throughout.

The heat resistant resin forming the resistance heating layer 31*b* is polyimide (PI), Polyphenylene Sulfide (PPS), Polyether Ether Ketone (PEEK), or the like. Among these, PI is preferable, as PI has the greatest heat resistance. In the present embodiment, PI is used.

For the conductive filler, a powder of a metal material with low electrical resistance (high conductivity) and a carbon compound powder with high electrical resistance (low conductivity) are preferably used, As the high-ion conductive powder material, a high-ion conductive powder material in an inorganic compound such as silver iodide (AgI) or copper iodide (CuI) is preferably used. As the powder of a metal material, particles of a metal material such as Ag, Cu, Al, Mg, Ni, or the like are preferable. As the carbon compound powder, graphite, carbon black, carbon nanofiber, or carbon nanotube is preferable.

The high-ion conductive powder material does not run the risk of lowering the mechanical strength of the resistance heating layer 31*b*. With only high-ion conductive powder material and high-resistance carbon compound powder, however, it is difficult to adjust the electrical resistance of the resistance heating layer 31*b* to yield a predetermined amount of heat in a fixing device using power from a commercial power supply of approximately 500 W to 1500 W. Low-resistance metal powder is therefore used. By using the metal powder, the carbon compound powder, and the high-ion conductive powder material, the resistance heating layer 31*b* can easily be adjusted to a predetermined electrical resistance without lowering the mechanical strength.

Note that any of the low-resistance metal powder, the high-resistance carbon compound powder, and the high-ion conductive powder material may be composed of two or more types of material.

It is also preferable that the low-resistance metal powder, the high-resistance carbon compound powder, and the high-ion conductive powder material each be fibrous. This is because if the metal powder, carbon compound powder, and high-ion conductive powder material are fibrous, the probability of these materials coming into contact increases, thus facilitating percolation.

When using silver iodide (AgI) or copper iodide (CuI) as the high-ion conductive powder material, the rate of change in resistance varies greatly, with the resistance dramatically decreasing at a certain temperature (the phase transition point). This greatly increases the effect of preventing an excessive increase in temperature in the non-sheet conveyance region. The phase transition point of AgI is normally 147° C., but this temperature depends on the particle diameter of AgI: as the particle diameter decreases, the phase transition point lowers. The same is true for CuI as well.

Accordingly, depending on the fixing temperature, a predetermined phase transition point can be established by selecting an appropriate particle diameter of the material that is mixed in as AgI or CuI. In particular, when the material has a small particle diameter, AgI or CuI may be synthesized be a simple method of mixing, filtering, and drying, at normal temperature and normal pressure, the following: an aqueous solution of silver nitrate ($AgNO_3$), an aqueous solution of sodium iodide (NaI), and an aqueous solution of PVP (Poly-N-vinyl-2-pyrrolidone), which is an organic polymer that conducts silver ions. By changing the concentration of the solutions and the mixing procedure, nanoparticles with different sizes in a range from 10 nm to 50 nm may also be formed.

The particle diameter of the silver powder is preferably in a range of approximately 0.01 μm to 10 μm. With this particle diameter, the high-resistance carbon compound powder and the high-ion conductive powder material mix together throughout in a linear form, thus endowing the resistance heating layer 31*b* with a uniform electrical resistance throughout.

It is preferable that in the conductive filler dispersed in heat resistant resin, the low-resistance metal powder be 50% to 300% by weight, and the high-resistance carbon compound powder and the high-ion conductive powder material be 50% to 100% by weight with respect to the heat resistant resin. If any of the metal powder, the carbon compound powder, or the high-ion conductive powder material is over 300% by weight, the electrical resistance of the resistance heating layer 31*b* may decrease excessively. Conversely, if any of these are less than 50% by weight, the electrical resistance of the resistance heating layer 31*b* may become too high. Therefore, it is not easy to adjust the volume resistivity to a predetermined value when either the materials are over 300% or under 50% by weight. The range of 50% to 300% by weight is thus preferable.

While the thickness of the resistance heating layer 31*b* is arbitrary, a range of approximately 5 μm to 100 μm is preferable.

The electrical resistance of the resistance heating layer 31*b* may be set freely based on the power supplied to the resistance heating layer 31*b*, the voltage applied, the thickness of the resistance heating layer 31*b*, the diameter and length in the axial direction of the fixing roller 33, and the like. Preferably, however, the electrical resistance is in a range of approximately $1.0\times10^{-6}\Omega$ to $1.0\times10^{-2}\Omega$, and more preferably in a range of approximately $1.0\times10^{-5}\Omega$ to $5.0\times10^{-3}\Omega$.

In order to adjust the volume resistivity of the resistance heating layer 31*b*, conductive particles of a metal alloy, an intermetallic compound, or the like may be mixed in. Furthermore, in order to improve the mechanical strength of the resistance heating layer 31*b*, it is possible to mix in glass fiber, whiskers (needle-like single crystal metal), titanium oxide, potassium titanate, or the like.

In order to improve the thermal conductivity of the resistance heating layer 31*b*, aluminium nitride, alumina, or the like may be mixed in.

In order to stably manufacture the resistance heating layer 31*b*, an imide agent, a coupling agent, a surface active agent, an antifoaming agent, or the like may be mixed in.

The resistance heating layer 31*b* may be manufactured by, for example, polymerizing an aromatic tetracarboxylic dianhydride and an aromatic diamine in an organic solvent to yield polyimide varnish, uniformly dispersing conductive filler in the polyimide varnish, pouring the result into a cylindrical metal mold and causing imide conversion.

The elastic layer 31*c* of the heating belt 31 is formed from a highly heat resistant elastic body, such as silicone (Si) rubber or fluorine-containing rubber. In the present embodiment, silicone rubber is used for the elastic layer 31*c*.

The releasing layer 31*d* of the heating belt 31 is provided with mold release characteristics by a fluorine-containing tube or a fluorine-containing coating, examples of which are PFA (Poly tetra Fluoro Ethylene), PTFE (Poly Tetra Fluoro Ethylene), and ETFE (Ethylene Tetra Fluoro Ethlylene). Preferably, the thickness of the releasing layer 31*d* is approximately 5 μm to 100 μm. Preferable examples of the fluorine-containing tube include product numbers PFA350-J, 451HP-J, and 951HP Plus by Du Pont-Mitsui Fluorochemicals Co., Ltd.

The releasing layer 31*d* has releasability whereby a recording sheet S that touches the releasing layer 31*d* when passing through the fixing nip N is easily released.

For example, the contact angle with water for the releasing layer 31*d* is 90° C. or greater, and preferably 110° C. or greater, and the surface roughness Ra is preferably in a range of approximately 0.01 μm to 50 μm. The releasing layer 31*d* may be conductive. In the present embodiment, PFA is used for the releasing layer 31*d*.

The reinforcing layer 31*a*, the resistance heating layer 31*b*, the elastic layer 31*c*, and the releasing layer 31*d* are each a predetermined thickness. The resulting heating belt 31 is rigid so as to retain a cylindrical shape with a predetermined diameter when not being pressed upon by the pressing roller 32. The fixing roller 33 changes shape when pressed upon by the pressing roller 32, and the heating belt 31 changes shape accordingly so as to curve along the outer circumferential surface of the pressing roller 32.

Note that the heating belt 31 is not limited to the four-layer structure described above. Rather, a two-layer structure with the resistance heating layer 31*b* and the releasing layer 31*d* may be adopted. In either case, a resin layer of PI, PPS, or the like may be further provided for insulation. Note that in either case, the resistance heating layer 31*b* should be positioned further inward than the releasing layer 31*d*.

The conductive body constituting each electrode 31*g* may be formed by chemical plating or electrical plating of a metal, such as Cu, Al, Ni, brass, phosphor bronze, or the like, directly on the resistance heating layer 31*b*.

When the electrodes 31*g* are formed by plating of a metal, it is preferable for two or more types of metal to be plated. For example, the electrodes 31*g* may be formed by first chemically plating Cu directly on the resistance heating layer 31*b* and then electrically plating Ni on the Cu.

The electrodes 31*g* are not limited to this structure. Alternatively, a metal foil of Cu, Ni, or the like may be attached to the resistance heating layer 31*b* by a conductive adhesive.

Furthermore, the electrodes 31*g* may be formed by applying a conductive ink or conductive paste to the resistance heating layer 31*b*. Alternatively, the electrodes 31*g* may be formed by attaching conductive tape to the resistance heating layer 31*b*.

The fixing roller 33, which is provided within the rotational area of the heating belt 31, has a metal core 33*a* provided along the axis and an elastic layer 33*b* layered on the outer circumferential surface of the metal core 33*a*. The ends of the metal core 33*a* extend beyond the outer edges of the elastic layer 33*b*.

The metal core 33*a* is composed of a shaft of a fixed diameter onto which is fit a metal cylinder (either solid or hollow) made from aluminium, iron, or the like and having a diameter of approximately 10 mm to 30 mm. The ends of the shaft extend beyond the outer edges of the cylinder in the axial direction. The elastic layer 33*b* is composed of an elastic material that is highly heat resistant such as silicone rubber, fluorine-containing rubber, or the like. The length of the elastic layer 33*b* in the axial direction is approximately equal to the length of the heating belt 31 in the axial direction.

The pressing roller 32 includes a metal core 32*a*, an elastic layer 32*b* layered on the outer circumferential surface of the metal core 32*a*, and a releasing layer 32*c* layered on the outer circumferential surface of the elastic layer 32*b*. The outer diameter of the pressing roller 32 is in a range of approximately 20 mm to 100 mm.

Like the metal core 33*a* of the fixing roller 33, the metal core 32*a* of the pressing roller 32 is composed of a shaft of a fixed diameter onto which is fit a metal cylinder made from aluminium, iron, or the like and having a diameter in a range of approximately 10 mm to 30 mm. The elastic layer 32*b* is formed from a highly heat resistant elastic body, such as silicone rubber or fluorine-containing rubber. The thickness of the elastic layer 32*b* is in a range of approximately 1 mm to 20 mm.

The releasing layer 32*c* is formed from a material having mold release characteristics with respect to the recording sheet, such as a fluorine-containing tube or a fluorine-containing coating, examples of which are PFA (Poly tetra Fluoro Ethylene), PTFE (Poly Tetra Fluoro Ethylene), and ETFE (Ethylene Tetra Fluoro Ethlylene). The thickness of the releasing layer 32*c* is, for example, in a range of approximately 5 μm to 100 μm. Note that the releasing layer 32*c* may be conductive so as to prevent toner offset.

In a state parallel to the fixing roller 33, the pressing roller 32 is biased towards the heating belt 31 by a biasing means (such as an extension spring) not shown in the figures. As a result, the outer circumferential surface of the pressing roller 32 presses against the outer circumferential surface of the heating belt 31, and the heating belt 31 is pressed against the fixing roller 33. The fixing nip N, through which the recording sheet S traverses, is formed at the location where the heating belt 31 and the pressing roller 32 press against each other.

As shown in FIG. 2, the pressing roller 32 rotates in the direction of the arrow D1 in FIG. 2 due to a fixing motor 38. By being pressed upon by the pressing roller 32 and the fixing roller 33, the heating belt 31 rotates in the direction of the arrow D2 in FIG. 2 as a result of rotation by the pressing roller 32. The fixing roller 33, which is pressed against by the heating belt 31, rotates in the same direction as a result of the rotation by the heating belt 31.

Note that instead of a structure in which the pressing roller 32 is driven to rotate, the fixing device 30 may be structured so that the fixing roller 33 is rotated by the fixing motor 38. Alternatively, both the pressing roller 32 and the fixing roller 33 may be rotated by the fixing motor 38.

A recording sheet S is transported to the fixing nip N while the pressing roller 32 and the heating belt 31 are rotating, and the heating belt 31 is heated by current provided from the alternating power source 34 via the power regulating unit 35. While traversing the fixing nip N, the recording sheet S is pressed upon and heated by the heating belt 31, which is in a heated state, so that the unfixed toner image on the recording sheet S is fixed thereon.

Operations of Fixing Device

When the fixing device with the above structure is instructed to perform a print job, the fixing motor 38 is driven, and the pressing roller 32 begins to rotate. As a result, the heating belt 31 rotates. Alternating power from the alternating power source 34 is regulated by the power regulating unit 35 and applied across the power feeders 37. As a result, a predetermined power is supplied to the resistance heating layer 31*b*. Note that when the heating belt 31 is not rotating, the alternating power from the alternating power source 34 is not applied to the power feeders 37.

When power is applied to the power feeders 37, the current applied to one of the power feeders 37 flows from the electrode 31*g* pressed against the power feeder 37 through the resistance heating layer 31*b* to the other electrode 31*g* and the other power feeder 37. As a result, the resistance heating layer 31*b* heats up, causing the entire heating belt 31 to enter a heated state.

Once the heating belt 31 has heated up to a predetermined surface temperature, a recording sheet S onto which a toner image has been transferred is transported to the fixing nip N formed by the heating belt 31 and the pressing roller 32 pressing against each other. While the recording sheet S traverses the fixing nip N, the toner image on the recording sheet S is heated and pressed upon so as to be fixed to the recording sheet S.

During these fixing operations, the power regulating unit 35 regulates the amount of power provided from the alternating power source 34 to the power feeders 37 based on the surface temperature, at a central region in the direction of width of the heating belt 31, detected by the temperature sensor 36. The heating belt 31 is thus kept at a predetermined fixing temperature.

Based on the surface temperature of the heating belt 31 as measured at the measurement regions 36*a* by thermopiles in the temperature sensor 36, control is performed for determination of occurrence of an abnormality, such as a scratch, in the resistance heating layer 31*b* of the heating belt 31.

Structure of Control

Figure 5:
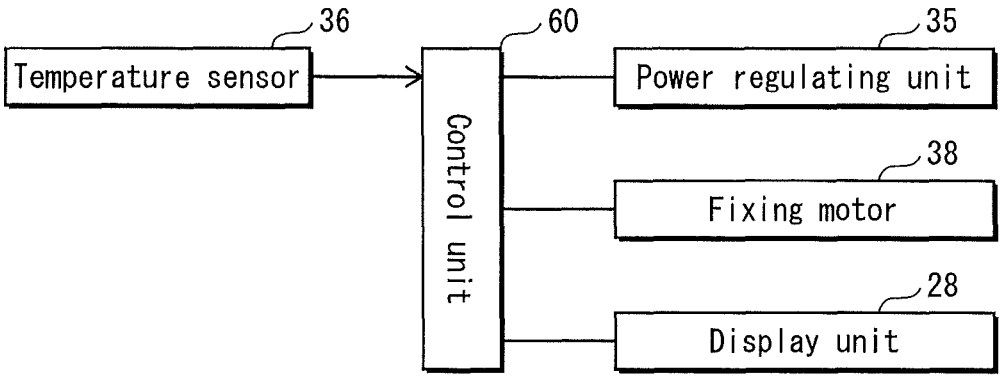
FIG. 5 is a block diagram illustrating the structure of the main components related to control of the fixing device shown in FIG. 2.

FIG. 5 is a block diagram illustrating the structure of the main components related to control of the fixing device 30. The fixing device 30 is controlled by a control unit 60 that controls the entire printer. The control unit 60 may be provided within the fixing device 30.

The output of the temperature sensor 36 provided in the fixing device 30 is transmitted to the control unit 60. The control unit 60 also controls the power regulating unit 35, which regulates the amount of power provided to the power feeders 37, and the fixing motor 38, which causes the pressing roller 32 to rotate so that the heating belt 31 rotates.

The temperature sensor 36 outputs the surface temperature of the heating belt 31 as measured at each of the measurement regions 36*a*. Based on the measured temperature input for each measurement region 36*a*, the control unit 60 determines whether an abnormality, such as a scratch, has occurred in the heating belt 31. Upon determining that an abnormality, such as a scratch, has occurred in the heating belt 31, the control unit 60 displays the results of the determination on a display device 28, such as a liquid crystal display, provided on an operation panel (not shown in the figures).

Furthermore, based on the surface temperature, at a central region in the direction of width of the heating belt 31, detected by a predetermined thermopile in the temperature sensor 36, the control unit 60 controls the power regulating unit 35 so that the heating belt 31 reaches a predetermined temperature, which is set in advance. As a result, the amount of power provided to the resistance heating layer 31*b* via the power feeders 37 is regulated so that the surface temperature of the heating belt 31 is kept at a predetermined temperature.

Note that when the surface temperature of the heating belt 31 detected by the temperature sensor 36 reaches a preset abnormally high temperature, the control unit 60 controls the power regulating unit 35 so as to suspend the supply of power to the heating belt 31. The surface temperature of the heating belt 31 at which the power supply to the heating belt 31 is suspended depends on the dimensions, materials, and the like of the heating belt 31. Normally, however, this temperature is a high temperature of at least 260° C.

Note that the amount of power supplied from the alternating power source 34 to the power feeders 37 is not limited to being regulated by the power regulating unit 35 based on the surface temperature of the heating belt 31 as detected by the temperature sensor 36. For example, apart from the temperature sensor 36, a temperature sensor that detects the surface temperature at the central region of the heating belt 31 in the direction of width may be provided, and the power regulating unit 35 may be controlled based on the results of detection by this temperature sensor so as to regulate the amount of power provided to the power feeders 37.

Control for Determination of Abnormality

Figure 6:
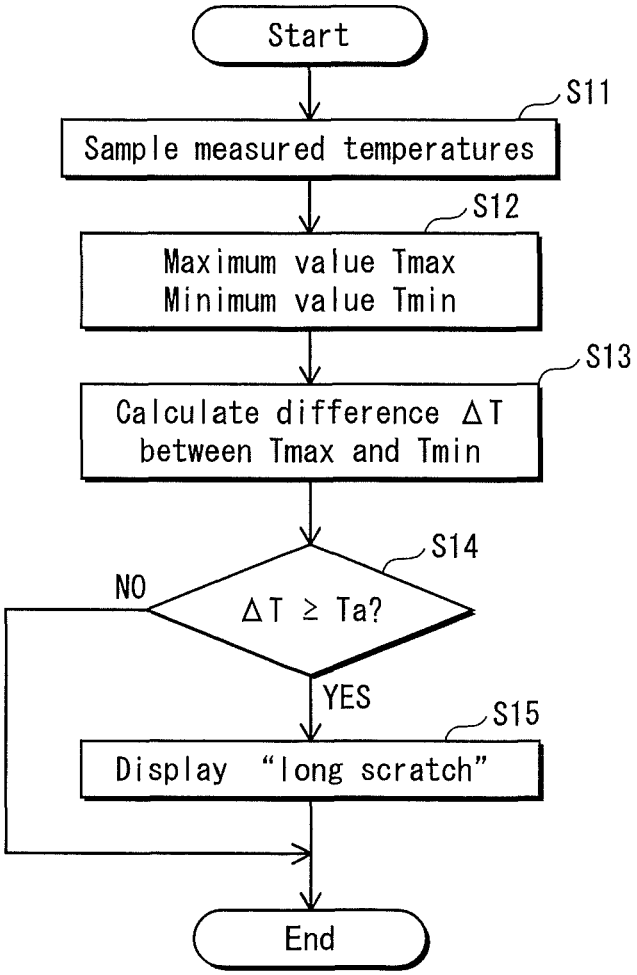
FIG. 6 is a flowchart showing procedures performed by a control unit shown in FIG. 5 during control for determination of an abnormality.

FIG. 6 is a flowchart showing procedures performed by the control unit 60 during control for determination of an abnormality in the heating belt 31. The control for determination of an abnormality is performed at a predetermined time that is set in advance. The time at which control for determination of an abnormality is performed may be either when a print operation is being performed or when a print operation is not being performed.

When the control for determination of an abnormality is performed at a time other than during print operations, then as during print operations, the fixing motor 38 is driven, the heating belt 31 is caused to rotate due to rotation of the pressing roller 32, and the power regulating unit 35 is controlled so that the surface temperature of the heating belt 31 reaches the same temperature as during normal operations for fixing plain paper.

Once the control for determination of an abnormality begins, the control unit 60 samples the measured temperature by all of the thermopiles in the temperature sensor 36 several times at a fixed interval while the heating belt 31 rotates once or multiple times (see step S11 in FIG. 6; the same is true below as well). In this case, the measurement regions 36*a* when each of the thermopiles is sampled are set to be continuous over the entire outer circumferential surface (one rotation) of the heating belt 31 and partially overlap in the circumferential direction of the heating belt 31. The number of samplings of one thermopile is, for example, approximately five to ten times for one rotation of the heating belt 31.

Note that the number of samplings of the surface temperature measured by the thermopiles per rotation of the heating belt 31 is preferably set so that for each rotation of the heating belt 31, the measurement regions 36*a* shift in the circumferential direction along the outer circumferential surface of the heating belt 31. By setting the number of samplings in this way, each time the heating belt 31 rotates, the surface positions on the heating belt 31 measured by the measurement regions 36*a* differ. This controls the effects of noise and allows for highly accurate detection of the temperature along the entire circumference of the heating belt 31.

At the end of the predetermined number of samplings of measured temperatures for each of the thermopiles, a maximum value (maximum temperature) Tmax and a minimum value (minimum temperature) Tmin are determined for each thermopile from among all of the measured temperatures that have been sampled (step S12).

The next step is to calculate, for each thermopile, a temperature difference ΔT between the maximum temperature Tmax and the minimum temperature Tmin that were determined from the measured temperatures (step S13). Once the temperature difference ΔT has been calculated from the maximum temperature Tmax and the minimum temperature Tmin determined from the measured temperatures for each thermopile, it is determined whether each temperature difference ΔT is at least a first threshold Ta (step S14).

This first threshold Ta is set to be the difference between the maximum temperature and the minimum temperature (approximately 20° C.) in the actual measured temperatures, acquired by sampling the temperatures measured by the thermopiles while displacing the measurement regions 36*a* across the entire circumference of the heating belt 31, when a scratch has occurred on the resistance heating layer 31*b* of the heating belt 31, the scratch extending over 20% of the circumference length of the heating belt 31 (e.g. 20 mm when the circumference length of the heating belt 31 is 100 mm).

As a result of comparing the temperature differences ΔT and the first threshold Ta in step S14, if each temperature difference ΔT is less than the first threshold Ta (step S14: NO), then it is determined that along the surface of the heating belt 31 in a range over which the measurement region 36*a* was displaced for each thermopile, either a short scratch extending across less than 20% of the circumferential length of the heating belt 31 has occurred on the resistance heating layer 31*b* of the heating belt 31, or no scratch has occurred. In this case, control for determination of an abnormality terminates.

If a scratch occurring in the resistance heating layer 31*b* is less than 20% of the circumferential length of the heating belt 31, or if no scratch has occurred, then there is no risk of the surface temperature of the heating belt 31 reaching a temperature high enough to damage the pressing roller 32. Therefore, no risk of damage to the pressing roller 32 occurs even if fixing operations continue. Accordingly, the control for determination of an abnormality is terminated without displaying a warning or the like, so that printing operations may continue to be performed.

On the other hand, in step S14, if for any of the thermopiles the temperature difference ΔT is at least the first threshold Ta (step S14: YES), then it is determined that along the surface of the heating belt 31 in a range over which the measurement region 36*a* for the thermopile was displaced, a scratch extending across at least 20% of the circumferential length of the heating belt 31 has occurred on the resistance heating layer 31*b* of the heating belt 31. A message indicating that a long scratch has occurred is displayed on the display unit of the operation panel (step S15). In this case, it is also displayed that print operations must be prohibited.

Note that alternatively, a structure may be adopted to cause the power regulating unit 35 not to supply power to the heating belt 31 via the power feeders 37, or to prohibit fixing operations by both suspending the supply of power to the heating belt 31 and simultaneously suspending rotation of the fixing motor 38, when a long scratch extending across at least 20% of the circumferential length of the heating belt 31 is determined to have occurred on the resistance heating layer 31*b*. In this case, instead of displaying a message on the display unit 28 that print operations must be prohibited, a message indicating that print operations have been prohibited may be displayed.

Adopting such a structure to prohibit fixing operations when it is determined that a long scratch extending across at least 20% of the circumferential length of the heating belt 31 is determined to have occurred on the resistance heating layer 31*b* reliably prevents damage to the pressing roller 32 due to a locally high temperature in the heating belt 31.

Next, it is described why, for each thermopile in the temperature sensor 36, it can be determined whether a scratch of a predetermined length or greater can be determined to have occurred in the resistance heating layer 31*b* of the heating belt 31 based on the temperature difference ΔT between the maximum temperature Tmax and the minimum temperature Tmin determined from among the measured temperatures.

If a scratch occurs on the resistance heating layer 31*b* of the heating belt 31 along the circumferential direction of the heating belt 31, current cannot flow in the direction of width of the heating belt 31 at the location of the scratch, but rather must flow by detouring around the scratch. As a result, the amount of current at the circumferential ends (either end in the circumferential direction) of the scratch increases, causing the amount of heat at the circumferential ends to increase. This leads to a higher temperature at the circumferential ends of the scratch than at a central region of the scratch.

Figures 7A, 7B, 7C:
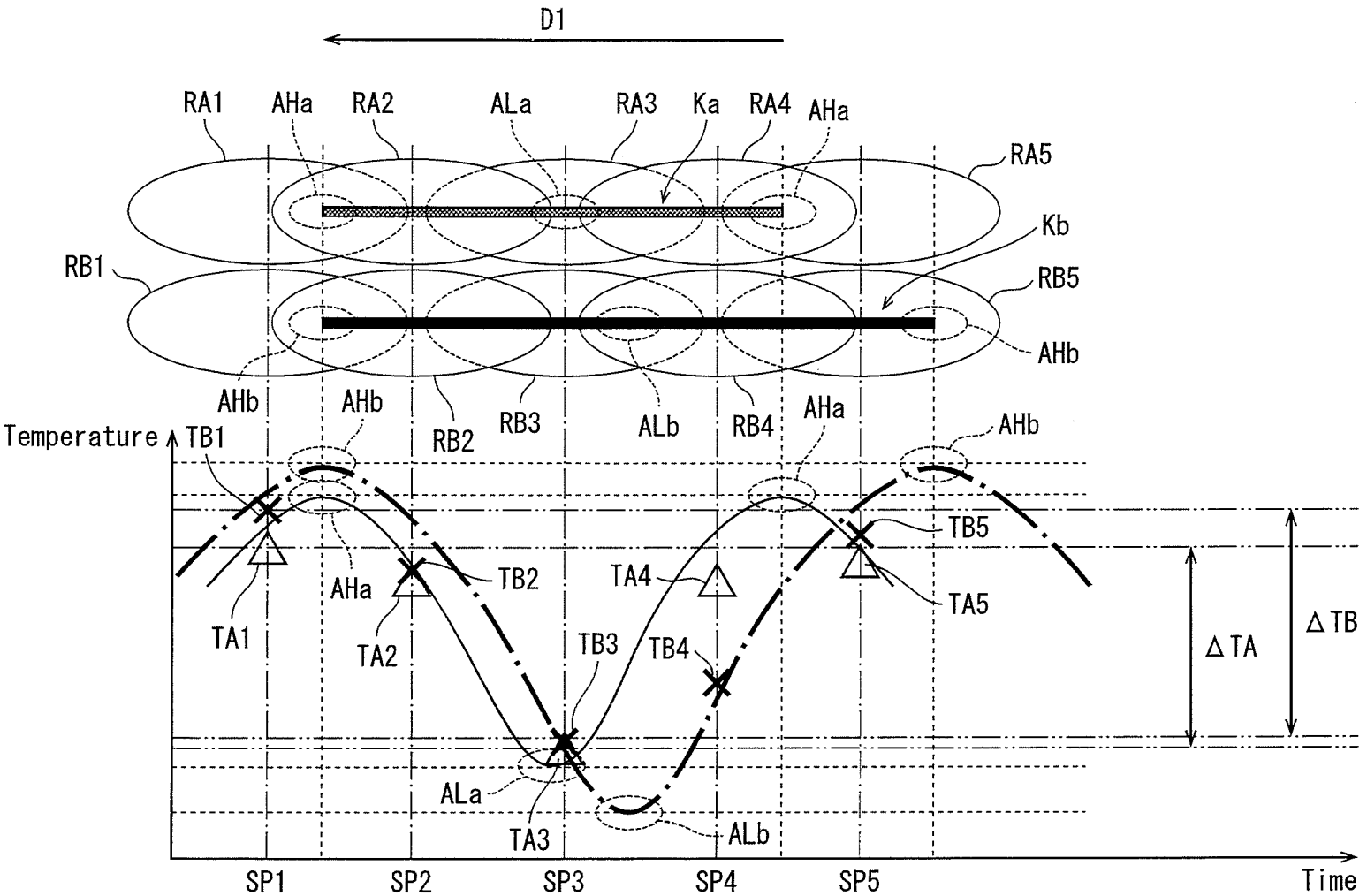
FIGS. 7A and 7B are schematic diagrams showing an example of sampling times of measured temperatures for the case when a short scratch and a long scratch have occurred in the circumferential direction of the heating belt in one measurement region of a temperature sensor used during control for determination of an abnormality.
FIG. 7C is a graph showing the temperature around the scratches shown in FIGS. 7A and 7B.

FIGS. 7A and 7B are schematic diagrams showing the case when a short scratch Ka and a long scratch Kb have each occurred in the circumferential direction of the heating belt 31 in a range over which the measurement region 36*a* for one thermopile in the temperature sensor 36 is displaced. In FIGS. 7A and 7B, the measured temperature is sampled at predetermined times for the thermopiles whose respective measurement regions 36*a* include the short scratch Ka and the long scratch Kb.

Note that the arrow D1 indicates the direction of rotation of the heating belt 31. The end of the short scratch Ka and of the long scratch Kb located downstream in the direction of rotation are aligned in the direction of width of the heating belt 31. The scratches Ka and Kb are both more than approximately 30% of the circumferential length of the heating belt 31 (e.g. approximately 30 mm when the length of the heating belt 31 in the circumferential direction is 100 mm).

FIG. 7C is a graph showing the actual surface temperature of the heating belt 31 around the short scratch Ka and the long scratch Kb shown in FIGS. 7A and 7B. Note that the solid line (thin line) in FIG. 7C shows the temperature around the short scratch Ka, whereas the alternating long and short dashed line (thick line) shows the temperature around the long scratch Kb.

As shown in FIG. 7C, the heating belt 31 reaches the highest temperature at either circumferential end of the scratches Ka and Kb in the direction of length thereof and reaches the lowest temperature at the central region in the direction of length.

As shown in FIG. 7C, the measured temperature in the measurement region 36*a* is sampled five times for the thermopiles whose respective measurement regions 36*a* include either the scratch Ka or the scratch Kb (first through fifth sampling times SP1, SP2, SP3, SP4, and SP5). In this case, the center of the measurement region 36*a* at the third sampling time SP3 matches the center of the short scratch Ka in the direction of length thereof.

FIGS. 7A and 7B show the measurement regions 36*a* at each of the first through the fifth sampling times SP1, SP2, SP3, SP4, and SP5. In FIG. 7A, the measurement region 36*a* for the short scratch Ka is labeled RA1, RA2, RA3, RA4, and RA5 at the respective one of the first through the fifth sampling times. In FIG. 7B, the measurement region 36*a* for the long scratch Kb is labeled RB1, RB2, RB3, RB4, and RB5 at the respective one of the first through the fifth sampling times.

The measured temperature at each of the first through fifth measurement regions RA1, RA2, RA3, RA4, and RA5 (the average temperature within each measurement region) is respectively labeled TA1, TA2, TA3, TA4, and TA5 and shown by a triangle in the graph in FIG. 7C. Similarly, the measured temperature at each of the first through fifth measurement regions RB1, RB2, RB3, RB4, and RB5 (the average temperature within each measurement region) is respectively labeled TB1, TB2, TB3, TB4, and TB5 and shown by an X in the graph in FIG. 7C.

The first measurement region RA1, which corresponds to the first sampling time SP1, includes a region with a locally high temperature at the circumferential end of the short scratch Ka that is downstream in the direction of rotation (the high temperature region AHa shown by a dashed line in FIGS. 7A and 7C). The high temperature region AHa, however, is shifted from the center of the measurement region in the circumferential direction, and the measurement region includes a large region with a lower temperature than the high temperature region AHa. As a result, the measured temperature TA1 (the average temperature of the first measurement region RA1) is lower than the actual temperature of the high temperature region AHa. This measured temperature TA1 is, for example, approximately 200° C.

Next, the second measurement region RA2, which corresponds to the second sampling time SP2, also includes the high temperature region AHa at the circumferential end of the short scratch Ka that is downstream in the direction of rotation. The second measurement region RA2 also, however, includes a large region with a lower temperature than the high temperature region AHa, so that the measured temperature TA2 (the average temperature of the second measurement region RA2) is lower than the actual temperature of the high temperature region AHa.

Furthermore, the third measurement region RA3, which corresponds to the third sampling time SP3 and includes the central region of the short scratch Ka in the direction of length thereof, includes a region with a locally low temperature (low temperature region ALa) but also includes a large area with a higher temperature than the low temperature region ALa. The measured temperature TA3 (the average temperature of the third measurement region RA3) is therefore higher than the actual temperature of the low temperature region ALa. For example, the measured temperature TA3 may be 160° C. In this case, the center of the third measurement region RA3 matches the center in the direction of length of the short scratch Ka. As a result, the third measurement region RA3 includes large surrounding regions with a small difference in temperature from the low temperature region ALa. The difference between the measured temperature TA3 and the actual temperature is therefore small.

The fourth measurement region RA4, which corresponds to the fourth sampling time SP4, includes a high temperature region AHa at the circumferential end of the short scratch Ka that is upstream in the direction of rotation but also includes a large area with a lower temperature than the high temperature region AHa. The measured temperature TA4 is thus similar to the measured temperature TA2 in the second measurement region RA2.

Furthermore, the fifth measurement region RA5, which corresponds to the fifth sampling time SP5, also includes the high temperature region AHa at the circumferential end of the short scratch Ka that is upstream in the direction of rotation but also includes a large area with a lower temperature than the high temperature region AHa. The measured temperature TA5 is thus similar to the measured temperature TA1 in the first measurement region RA1 (approximately 200° C.).

In this case, the measured temperature TA1 at the first sampling time SP1 (the average temperature of the first measurement region RA1 that includes the high temperature region AHa) is the maximum temperature (maximum value) Tmax. The measured temperature TA3 (the average temperature of the third measurement region RA3 that includes the low temperature region ALa) is the minimum temperature (minimum value) Tmin. The temperature difference ΔTA between the maximum temperature Tmax (TA1) and the minimum temperature Tmin (TA3) is approximately 40° C.

Measurements for the long scratch Kb are similar. The measured temperature TB1 for the measurement region RB1, which corresponds to the first sampling time SP1 and includes a high temperature region AHb at the circumferential end of the long scratch Kb that is downstream in the direction of rotation, is a high temperature, for example 220° C.

The measured temperature TB2 for the measurement region RB2 (which includes the high temperature AHb) corresponding to the second sampling time SP2 includes a portion with a temperature that is progressively lower from the end of the scratch Kb towards a low temperature region ALb in the central region of the scratch Kb. Therefore, the measured temperature TB2 is lower than the measured temperature TB1 (for example, 160° C.).

Furthermore, the measurement region RB3, which corresponds to the third sampling time SP3 and includes a low temperature region ALb at the central region of the long scratch Kb in the direction of length thereof, also includes a large area with a higher temperature than the low temperature region ALb. Therefore, the measured temperature TB3 for the measurement region RB3 is lower than the measured temperature TB2 (for example, 160° C.). Note that the actual temperature in the low temperature region ALb at the central region of the long scratch Kb in the direction of length thereof is approximately 140° C.

The measurement region RB4 corresponding to the fourth sampling time SP4 includes the low temperature region ALb at the central region of the long scratch Kb in the direction of rotation, but also includes a large area with a higher temperature than the low temperature region ALb. Therefore, the temperature for the measurement region RB4 is higher than the low temperature region ALb.

In the measurement region RB5, which includes the high temperature region AHb and corresponds to the fifth sampling time SP5, the measured temperature TB5 is similar to the measured temperature TB1 for the first sampling time SP1 (approximately 220° C.).

In this case, the measured temperature TB1 at the first sampling time SP1 (the average temperature in the first measurement region RB1, which includes the high temperature region AHb) is the maximum temperature (maximum value) Tmax. The measured temperature TB3 at the third sampling time SP3 (the average temperature in the third measurement region RB3) is the minimum temperature (minimum value) Tmin. The temperature difference ΔTB between the maximum temperature Tmax (TB1) and the minimum temperature Tmin (TB3) is approximately 60° C.

As is clear, the temperature differences (ΔTA and ΔTB) between the locally high temperature region (AHa or AHb) and the low temperature region (ALa or ALb) around each scratch are not equal: the temperature difference for the long scratch Kb, which is longer in the circumferential direction of the heating belt 31, is greater than for the short scratch Ka (ΔTB>ΔTA). This is because for a long scratch, the current has to make a larger detour than for a short scratch. Therefore, the current density in the central region lowers, while the current density at either end becomes higher.

Based on this, if the temperature difference (ΔTA, ΔTB) between the maximum temperature Tmax and the minimum temperature Tmin, among the measured temperatures acquired by sampling while displacing the measurement regions 36*a* of the thermopiles across the entire circumference of the heating belt 31, is at least a predetermined temperature, then a locally high temperature region (AHa or AHb) and low temperature region (ALa or ALb) have been produced by a scratch of a predetermined length along the circumferential direction of the heating belt 31. It can therefore be determined that a scratch of at least a predetermined length has occurred in the resistance heating layer 31*b*.

Normally, when a scratch is approximately 30% of the circumferential length of the heating belt 31 (approximately 30 mm if the circumferential length of the heating belt 31 is 100 mm), the pressing roller 32 may be damaged. Therefore, in the present embodiment, it is determined that a scratch that may damage the pressing roller 32 has occurred upon detecting a temperature difference of at least approximately 20° C., which corresponds to a scratch of approximately 20% of the circumferential length of the heating belt 31 (approximately 20 mm if the circumferential length of the heating belt 31 is 100 mm).

Note that the measurement region 36*a* is larger than the high temperature regions AHa and AHb at either end in the direction of length of the scratches Ka and Kb and includes a region with a lower temperature than the high temperature regions AHa and AHb. As a result, the measured temperatures (TA1 and TA5, or TB2 and TB5) for the measurement regions (RA1 and RA5, or RB2 and RB5) that include the high temperature regions (AHa, AHb) at the ends of the scratches are lower than the actual temperature at the high temperature regions (AHa, AHb), since these measured temperatures are an average temperature of the entire corresponding measurement region.

It therefore follows that when determining whether the scratches Ka, Kb have occurred based on whether the maximum temperature (TA1, TB5) among the measured temperatures (TA1 through TA5 and TB1 through TB5) in the first through fifth measurement regions (RA1 through RA5 and RB1 through RB5) for the first through fifth sampling times (SP1 through SP5) is at least a predetermined threshold temperature, then the occurrence of the scratches Ka, Kb may not be accurately determined depending on how much lower the predetermined threshold temperature is than the temperature of the high temperature region.

In the present embodiment, it is determined whether a scratch of at least a predetermined length in the circumferential direction has occurred based not on the maximum temperature among the measured temperatures TA1 through TA5 and TB1 through TB5, but rather based on the temperature difference ΔT between the maximum temperature and the minimum temperature. This allows for accurate detection of a scratch of at least a predetermined length in the circumferential direction.

Note that the first threshold Ta varies depending on the physical properties, the dimensions, and the like of the resistance heating layer 31*b* in the heating belt 31. Therefore, the first threshold Ta is set appropriately based, for example, on experiment.

Furthermore, in the present embodiment, the control for determination of an abnormality has been described as being performed at a time other than during print operations, but this control may be performed during print operations as well. By doing so, an abnormality can be detected in a timely manner so that a warning can be provided, thus improving safety.

In the present embodiment, when the control for determination of an abnormality is performed at a time other than during print operations, power is supplied to the resistance heating layer 31*b* so that the heating belt 31 reaches the same temperature as during operations for fixing plain paper, as described above. Alternatively, however, the control for determination of an abnormality may be performed while increasing the amount of power supplied to the resistance heating layer 31*b* beyond the amount used during operations for fixing plain paper.

In this case, when a scratch has occurred on the resistance heating layer 31*b*, the difference in temperature between the maximum value and the minimum value among the measured temperatures sampled at the predetermined times becomes larger than the case described above. This allows for detection of a scratch of a predetermined length with even greater accuracy. Note that in this case, the first threshold Ta becomes a different value than above and is set based on the amount of power supplied to the resistance heating layer 31*b*.

Furthermore, in this case, if it is determined in step S14 that a scratch of at least 20% the circumferential length of the heating belt 31 has not occurred (step S14: NO), then based on the temperature difference ΔT obtained in step S13, it may be determined whether a shorter scratch has occurred.

In this case, the temperature difference ΔT obtained in step S13 is compared with a second threshold Tb that is a lower temperature than the first threshold Ta and that avoids misjudging that a scratch has occurred due to a temperature variation (temperature difference) on the surface of the heating belt 31 caused by the effects of, for example, a ripple in the power supplied to the resistance heating layer 31*b*. This second threshold Tb is, for example, set to the difference between the maximum temperature and the minimum temperature (approximately 10° C.) among the actual surface temperatures over the entire circumference of a section that includes a scratch on the resistance heating layer 31*b* extending circumferentially along approximately 10% of the circumferential length of the heating belt 31.

Accordingly, if the temperature difference ΔT obtained in step S13 is at least equal to the second threshold Tb, it is determined that a scratch has occurred on the resistance heating layer 31*b* extending circumferentially along approximately 10% of the circumferential length of the heating belt 31. In this case, even if a temperature variation (temperature difference) occurs on the surface of the heating belt 31 due to the effects of, for example, a ripple in the power supplied to the resistance heating layer 31*b*, the temperature variation is not mistakenly detected as the occurrence of a scratch on the resistance heating layer 31*b*.

Embodiment 2

Figure 8:
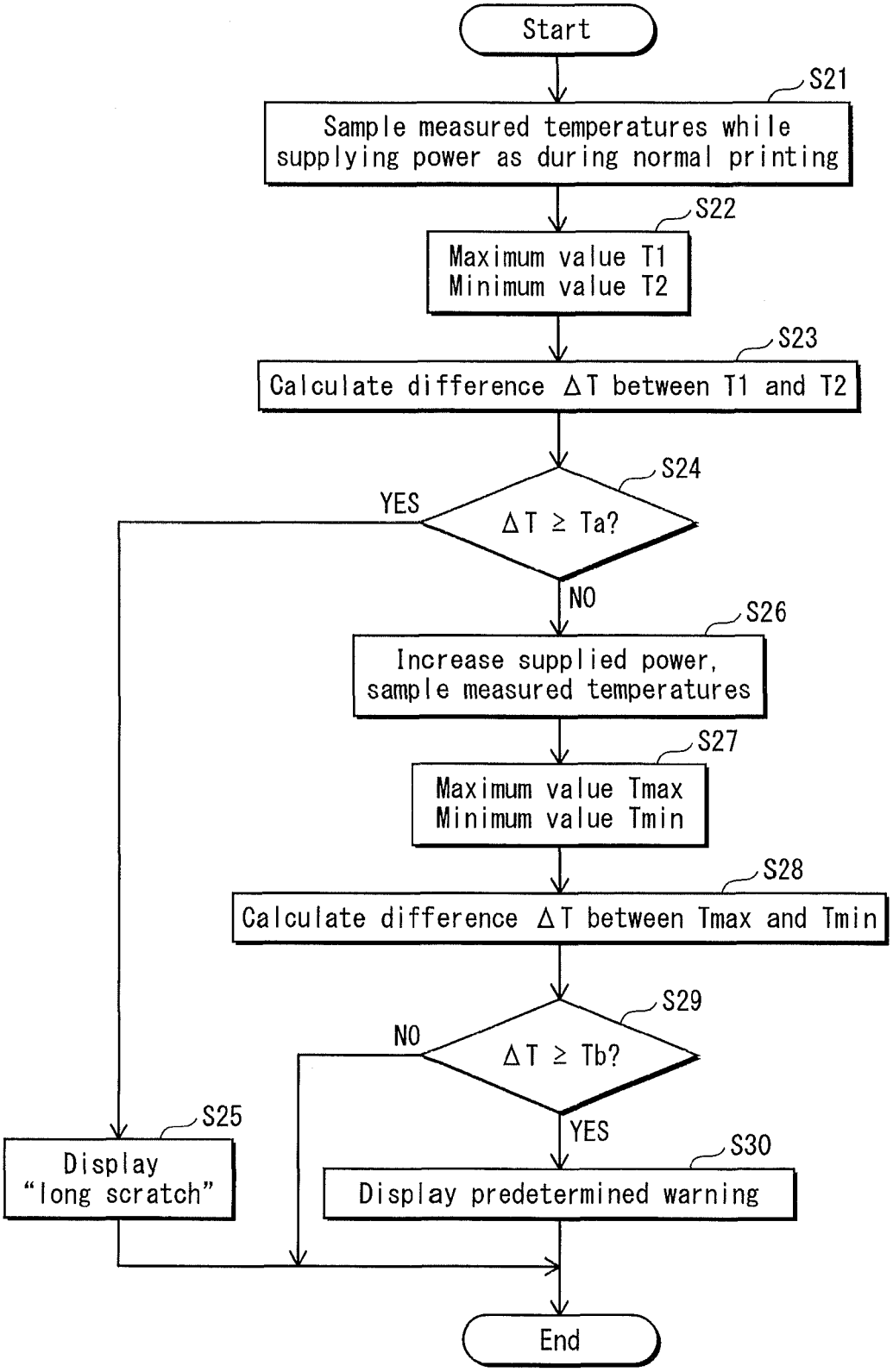
FIG. 8 is a flowchart showing procedures during control for determination of an abnormality in another embodiment of the present invention.

FIG. 8 is a flowchart showing procedures during control for determination of an abnormality in Embodiment 2. Like the control for determination of an abnormality in Embodiment 1, the control for determination of an abnormality in Embodiment 2 may also be performed either during print operations or at a time other than during print operations.

During the control for determination of an abnormality in the present embodiment, the heating belt 31 is rotated while causing the power regulating unit 35 to supply the same power to the resistance heating layer 31*b* of the heating belt 31 as the power supplied thereto when performing fixing operations for printing a recording sheet S that is plain paper, not thick paper. At similar sampling times as in Embodiment 1, the temperatures measured by all of the thermopiles are sampled (see step S21 of FIG. 8; the same is true below as well).

Note that when performing the control for determination of an abnormality during print operations for a recording sheet S that is plain paper, the power regulating unit 35 does not need to be specially controlled, as the power regulating unit 35 already supplies the power necessary for fixing operations to the heating belt 31.

Next, as in steps S12 through S14 in the flowchart in FIG. 6, the control unit 60 first determines the maximum temperature Tmax and the minimum temperature Tmin from among the measured temperatures that are sampled for each thermopile (step S22). The control unit 60 then calculates temperature differences ΔT between the maximum temperatures Tmax and the minimum temperatures Tmin (step S23). Next, the control unit 60 compares each calculated temperature difference ΔT with a first threshold Ta, which is a predetermined temperature (step S24). The first threshold Ta is the same as the first threshold Ta in Embodiment 1.

If for any of the thermopiles the temperature difference ΔT is at least the first threshold Ta (step S24: YES), then as in Embodiment 1, it is determined that along the surface of the heating belt 31 in a range over which the measurement region 36*a* for the thermopile was displaced, a scratch extending across at least 20% of the circumferential length of the heating belt 31 has occurred on the resistance heating layer 31*b* of the heating belt 31. A message indicating that a long scratch has occurred is displayed on the display unit 28 of the operation panel (step S25).

On the other hand, if the temperature difference ΔT is determined to be less than the first threshold Ta as a result of comparing the temperature difference ΔT and the first threshold Ta in step S24 (step S24: NO), then it is determined whether a scratch of less than 20% the circumferential length of the heating belt 31 has occurred on the resistance heating layer 31*b*.

To do so, the power regulating unit 35 is first caused to increase the power supplied to the resistance heating layer 31*b* of the heating belt 31 beyond the amount during fixing operations for a recording sheet S that is plain paper. In this state, the temperatures measured by all of the thermopiles are sampled at the same sampling times as in step S21 (step S26). The amount of power is increased in this case by, for example, 20% over the amount for fixing a toner image on plain paper.

When the control for determination of an abnormality is performed during print operations, the processing from steps S26 through S30 is performed after the completion of a print job.

Next, as in steps S22 through S24, the control unit 60 first determines the maximum temperature Tmax and the minimum temperature Tmin from among the measured temperatures that are sampled for each thermopile (step S27). The control unit 60 then calculates temperature differences ΔT between the maximum temperatures Tmax and the minimum temperatures Tmin (step S28). Next, the control unit 60 compares each calculated temperature difference ΔT with a second threshold Tb, which is a predetermined temperature (step S29). Like the second threshold Tb described in Embodiment 1, this second threshold Tb is set to the difference between the maximum temperature and the minimum temperature (approximately 10° C.) among the actual surface temperatures over the entire circumference of a section that includes a scratch on the resistance heating layer 31*b* extending circumferentially along approximately 10% of the circumferential length of the heating belt 31.

As a result of the comparison in step S29, if the temperature difference ΔT is less than the second threshold Tb (step S29: NO), then it is determined that a scratch has not occurred on the resistance heating layer 31*b*, and control for determination of an abnormality terminates.

On the other hand, if the temperature difference ΔT is at least the second threshold Tb (step S29: YES), it is determined that a small scratch that does not pose the risk of damaging the pressing roller 32 has occurred. A message is displayed on the display unit 28 provided in the operation panel to indicate that a small scratch (approximately 10% the circumferential length of the heating belt 31) has occurred on the heating belt 31, and that the scratch does not pose the risk of damage to the pressing roller even if fixing operations are performed (step S30). This allows for the user to be informed that a small scratch on the resistance heating layer 31*b* may, in the future, develop into a scratch that could damage the heating belt 31. Note that in this case, there is no need to prohibit fixing operations, since performance of normal fixing operations poses no problem.

By thus comparing the temperature difference ΔT between the maximum temperature Tmax and the minimum temperature Tmin among the temperatures measured by each thermopile with the second threshold Tb after increasing the power supplied to the resistance heating layer 31*b* of the heating belt 31, there is no danger of mistakenly determining that a scratch has occurred due to a temperature difference caused by the effects of a ripple in the power supplied to the resistance heating layer 31*b*. Accordingly, a short scratch of less than 10% the circumferential length of the heating belt 31 can accurately be detected.

Note that in step S29 of Embodiment 2, if it is determined that a scratch of approximately 10% the circumferential length of the heating belt 31 has occurred on the resistance heating layer 31*b* (step S29: YES), an additional determination may be made of whether increasing the amount of power supplied to the resistance heating layer 31*b* over the amount for performing fixing operations on plain paper would pose the risk of damage to the pressing roller 32 due to an increase in temperature of the heating belt 31 produced by the scratch on the resistance heating layer 31*b*.

In this case, the temperature difference ΔT obtained in step S28 is compared with a third threshold Tc. This third threshold Tc is set to a temperature difference (such as 15° C.) that allows for determination of the risk of damage to the pressing roller 32 due to the temperature in a high temperature region by the scratch on the resistance heating layer 31*b* when the amount of power supplied to the resistance heating layer 31*b* is increased approximately by 20% over the amount during fixing operations for plain paper.

This sort of temperature difference indicates, for example, that a scratch that is 15% or more of the circumferential length of the heating belt 31 has occurred and that if the amount of power supplied to the resistance heating layer 31*b* is increased to perform fixing operations for thick paper, the pressing roller 32 may be damaged. Accordingly, a message is displayed on the display unit 28 to indicate that print operations for thick paper are to be prohibited. A structure may further be adopted to prohibit performance of print operations for thick paper in this case.

Embodiment 3

Figure 9:
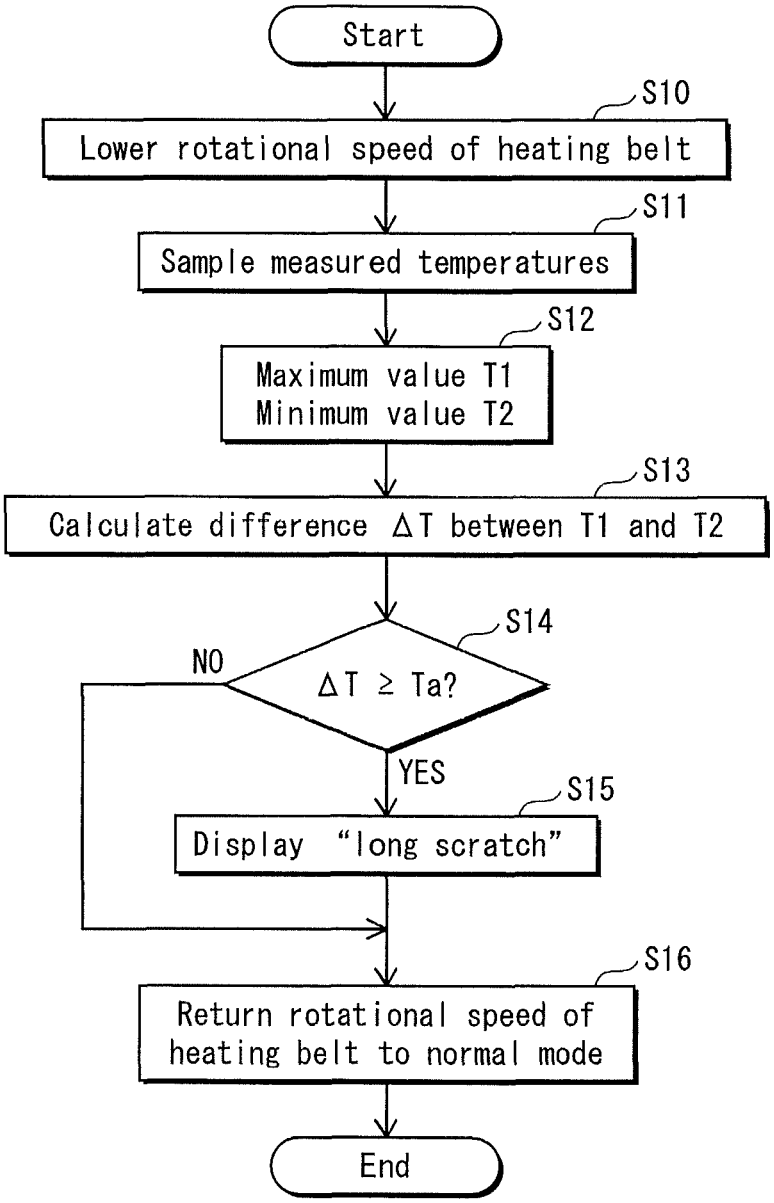
FIG. 9 is a flowchart showing procedures during control for determination of an abnormality in yet another embodiment of the present invention.

FIG. 9 is a flowchart showing procedures during control for determination of an abnormality in Embodiment 3. The control for determination of an abnormality in Embodiment 3 is performed while print operations are not being performed.

During the control for determination of an abnormality in Embodiment 3, the fixing motor 38 is controlled to reduce the rotation speed (circumferential displacement speed) of the heating belt 31 as compared to when printing operations are performed (see step S10 in FIG. 9; the same is true below as well). Following similar procedures as steps S11 through S15 in the flowchart in FIG. 6, the temperatures measured by all of the thermopiles are first sampled at predetermined times. Based on the temperature differences ΔT between the maximum temperatures Tmax and the minimum temperatures Tmin among the sampled temperature measurements, it is determined whether a scratch of at least a predetermined length has occurred on the resistance heating layer 31*b* of the heating belt 31. If so, a message to that effect is displayed on the display unit 28.

When the processing sequence from step S11 to step S15 is complete, processing proceeds to step S16, in which the fixing motor 38 is controlled to return the rotational speed of the heating belt 31 to the normal mode during printing operations. Control for determination of an abnormality then terminates.

In Embodiment 3, the control for determination of an abnormality is performed while the rotational speed (circumferential displacement speed) of the heating belt 31 is slower than during normal print operations. Therefore, by sampling the temperature measured by all of the thermopiles in the temperature sensor 36 at the same times as in Embodiment 1, the number of samplings per revolution of the heating belt 31 increases as compared to Embodiment 1. This allows for highly accurate measurement of the surface temperature of the heating belt 31 over the entire circumference, thereby allowing for highly accurate determination of whether a scratch has occurred on the resistance heating layer 31*b* and of the length of a scratch.

Modifications

In the above Embodiments, the fixing roller 33 and the heating belt 31 are described as separate bodies, with the fixing roller 33 being located inside the rotational area of the heating belt 31. The present invention is not, however, limited to this structure. The resistance heating layer 31*b* may be provided integrally on the outer circumferential surface of the fixing roller 33 in order to constitute the heating rotating body.

Furthermore, although in the above structures the pressing roller 32 presses against the heating belt 31 as a pressing means in order to form the fixing nip N, the pressing means for forming the fixing nip N is not limited to the pressing roller 32. A belt may be used instead. Additionally, the pressing means does not need to rotate like the pressing roller 32 or a belt. Rather, the pressing means may be a fixed pressing member or the like.

In the above embodiments, the power source for the fixing device 30 is a commercial alternating current power source. Alternatively, however, a direct current power source may be used.

The image forming apparatus according to the present invention is not limited to a printer that forms monochrome images and may also be used in a color printer, such as a tandem-type printer. Furthermore, the present invention is not limited to a printer, but may be adopted for use in a copier, multi-function peripheral (MFP), FAX, or the like (all of which may be for either color or monochrome images).

Summary of Embodiments

The fixing device according to an aspect of the present invention samples temperatures measured by the temperature measuring unit at times that allow for measurement of the surface temperature of the heating rotating body over the entire circumference thereof Based on the difference between the maximum temperature and the minimum temperature among the sampled temperatures, the fixing device determines whether an abnormality has occurred in the resistance heating layer in the circumferential direction, thus allowing for a highly accurate determination of whether such an abnormality has occurred.

The control unit may determine that the abnormality has occurred when the difference between the maximum temperature and the minimum temperature is at least a predetermined value.

While supplying the predetermined amount of power, when the control unit determines that an abnormality has not occurred, the control unit may re-sample temperatures measured by the temperature measuring unit in each of the plurality of regions while supplying a larger amount of power than the predetermined amount of power and determine whether an abnormality has occurred in accordance with the difference between a maximum temperature and a minimum temperature among the re-sampled temperatures in each of the plurality of regions.

The control unit may sample the temperatures measured by the temperature measuring unit in each of the plurality of regions while causing the heating rotating body to rotate at a lower rotational speed than during fixing operations.

During fixing operations, the control unit may perform the determination of whether an abnormality has occurred.

At a time other than during fixing operations, the control unit may perform the determination of whether an abnormality has occurred while supplying, to the resistance heating layer, a larger amount of power than an amount of power supplied during fixing operations.

An image forming apparatus according to an aspect of the present invention is provided with the above fixing device.

As described above, the present invention is useful as technology for accurately detecting whether an abnormality occurs in a resistance heating layer that heats up due to the flow of current.

Although the present invention has been fully described by way of examples with reference to the accompanying drawings, it is to be noted that various changes and modifications will be apparent to those skilled in the art. Therefore, unless such changes and modifications depart from the scope of the present invention, they should be constructed as being included therein.

What is claimed is:

1. A fixing device comprising:

a heating rotating body including a resistance heating layer;

a pressing member forming a nip by pressing against an outer circumferential surface of the heating rotating body and causing a recording sheet to pass through the nip, the recording sheet bearing an unfixed image;

a temperature measuring unit configured to measure a temperature in each of a plurality of regions extending partially along the outer surface of the heating rotating body in a circumferential direction and aligned in a direction of an axis of rotation of the heat rotating body; and a control unit configured to sample temperatures, measured by the temperature measuring unit in each of the plurality of regions, over the entire outer surface of the heating rotating body in the circumferential direction by causing the heating rotating body to rotate while supplying a predetermined amount of power to the resistance heating layer, and to determine whether an abnormality has occurred in the resistance heating layer in accordance with a difference between a maximum temperature and a minimum temperature among the sampled temperatures in a same region.

2. The fixing device of claim 1, wherein the control unit determines that the abnormality has occurred when the difference between the maximum temperature and the minimum temperature is at least a predetermined value.

3. The fixing device of claim 1, wherein while supplying the predetermined amount of power, when the control unit determines that an abnormality has not occurred, the control unit re-samples temperatures measured by the temperature measuring unit in each of the plurality of regions while supplying a larger amount of power than the predetermined amount of power and determines whether an abnormality has occurred in accordance with the difference between a maximum temperature and a minimum temperature among the re-sampled temperatures in each of the plurality of regions.

4. The fixing device of claim 1, wherein the control unit samples the temperatures measured by the temperature measuring unit in each of the plurality of regions while causing the heating rotating body to rotate at a lower rotational speed than during fixing operations.

5. The fixing device of claim 1, wherein during fixing operations, the control unit performs the determination of whether an abnormality has occurred.

6. The fixing device of claim 1, wherein at a time other than during fixing operations, the control unit performs the determination of whether an abnormality has occurred while supplying, to the resistance heating layer, a larger amount of power than an amount of power supplied during fixing operations.

7. An image forming apparatus including the fixing device of claim 1.

8. A fixing device comprising:

a heating rotating body including a resistance heating layer;

a pressing member forming a nip by pressing against an outer circumferential surface of the heating rotating body and causing a recording sheet to pass through the nip, the recording sheet bearing an unfixed image;

a temperature measuring unit configured to measure a temperature in each of a plurality of regions extending partially along the outer surface of the heating rotating body in a circumferential direction and aligned in a direction of an axis of rotation of the heat rotating body; and a control unit configured to sample temperatures, measured by the temperature measuring unit in each of the plurality of regions, over the entire outer surface of the heating rotating body in the circumferential direction by causing the heating rotating body to rotate while supplying a predetermined amount of power to the resistance heating layer, and to determine whether an abnormality has occurred in the resistance heating layer in accordance with a difference between a maximum temperature and a minimum temperature among the sampled temperatures in each of the plurality of regions, wherein while supplying the predetermined amount of power, when the control unit determines that an abnormality has not occurred, the control unit re-samples temperatures measured by the temperature measuring unit in each of the plurality of regions while supplying a larger amount of power than the predetermined amount of power and determines whether an abnormality has occurred in accordance with the difference between a maximum temperature and a minimum temperature among the re-sampled temperatures in each of the plurality of regions.

* * * * *